US005681113A

United States Patent [19]

Rifkin et al.

[11] Patent Number: 5,681,113

[45] Date of Patent: Oct. 28, 1997

[54] SECURITY BALLOT POUCH

[75] Inventors: Arnold S. Rifkin, Wilkes-Barre; John Hutnick, Larksville, both of Pa.

[73] Assignee: A. Rifkin Co., Wilkes-Barre, Pa.

[21] Appl. No.: 730,090

[22] Filed: Oct. 15, 1996

[51] Int. Cl.[6] ..... B65D 33/16

[52] U.S. Cl. ..... 383/5; 232/2; 232/44; 383/36; 383/41; 383/67

[58] Field of Search ..... 383/5, 43, 44, 383/36, 41, 66, 67, 61, 97; 232/44, 2; 109/46, 55, 66

[56] References Cited

U.S. PATENT DOCUMENTS

| | | | |
|---|---|---|---|
| 808,050 | 11/1905 | Beman | 232/2 |
| 911,286 | 2/1909 | Beman | 232/2 |
| 1,658,294 | 2/1928 | Lewis | 383/43 |
| 1,809,259 | 6/1931 | Williams | 383/44 |
| 2,942,450 | 6/1960 | Krug | 383/66 |
| 3,189,252 | 6/1965 | Miller | 383/57 |
| 3,229,902 | 1/1966 | Draddy et al. | 232/2 |
| 4,112,990 | 9/1978 | Anderson | 383/66 |
| 4,416,308 | 11/1983 | Bower | 383/57 |
| 4,661,990 | 4/1987 | Rifkin | 383/5 |
| 5,065,602 | 11/1991 | Williams et al. | 383/5 |
| 5,116,139 | 5/1992 | Young et al. | 383/36 |
| 5,354,132 | 10/1994 | Young et al. | 383/44 |

*Primary Examiner*—Stephen P. Garbe
*Attorney, Agent, or Firm*—Michael Ebert

[57] ABSTRACT

A tamper-proof security ballot pouch adapted to store ballots deposited therein and to prevent their unauthorized removal. The pouch includes a fabric bag in whose upper section is sewn a pair of parallel rods defining an entry slot to admit one ballot at a time. Depending from the upper section is a fabric chute creating a narrow open channel between the entry slot and the bag interior whereby a ballot inserted in the entry slot must pass through the channel before being deposited in the bag. Because the chute is flexible, when a ballot is inserted in the entry slot and advances into the narrow channel of the chute it then straightens out the chute, so that the channel is then in axial alignment with the entry slot. But once the ballot is deposited in the bag, its unauthorized exit through the entry slot is prevented by the chute, for regardless of how the pouch is manipulated, the deposited ballot cannot back track through the channel.

9 Claims, 2 Drawing Sheets

SECURITY BALLOT POUCH

BACKGROUND OF INVENTION

1. Field of Invention

This invention relates generally to ballot pouches adapted to accommodate ballots deposited therein, and more particularly to a security ballot pouch which is tamper-proof and prevents the unauthorized removal of deposited ballots stored therein.

2. Status of Prior Art

A ballot is a paper sheet or card used to cast or register a vote, usually a secret one. While a pouch in accordance with the invention is adapted to receive and store ballots, it is also useable as a depository for sheets or cards that are not ballots, but are completed survey forms or other filled out forms that must be collected.

Thus when a survey is conducted in a shopping mall in which a large number of shoppers are questioned regarding their preferences or objections to certain products, the responses of each shopper are entered on a survey form. There is a need therefore for a pouch in which to deposit for safekeeping the filled-out forms to be sure that the survey is accurate and has not been tampered with.

A conventional ballot box is made of metal, wood or other rigid material and is provided with a locked hinged cover having an entry slot therein to receive ballots, one at a time. The problem with a conventional ballot box is that it is possible to shake out the deposited ballots through the entry slot, particularly if it is wide relative to the thickness of the ballot sheet or card. Hence unauthorized personnel may be able to tamper with the vote or with whatever use the ballots are put to.

To prevent such tampering, the Graham U.S. Pat. No. 1,673,769 discloses a ballot box whose locked hinged cover has an entry slot therein, and a closure mounted on the underside of the entry slot. The closure takes the form of a pivoted plate that is weighted at one end so that the plate normally lies against the slot and is swung open only by a ballot inserted in the slot to admit the ballot into the box. But one cannot shake a deposited ballot out of the box, for then the entry slot is blocked by the plate.

The concern of the present invention is with ballot pouches fabricated of leather, fabric or other flexible material, for these are more easily carried and transported to a polling place than a rigid ballot box. Thus the Benson U.S. Pat. No. 806,050 shows a ballot pouch that includes a bag of flexible material such as leather or canvas having a rigid cover disc provided with an entry slot. To prevent tampering with the pouch, a spring-biased, hinged flap is mounted below the entry slot so that the flap is swung open by an inserted ballot. But once a ballot is deposited in the pouch, it is then blocked by the closed flap and cannot be withdrawn from the pouch through the entry slot.

Inasmuch as a ballot pouch in accordance with the invention, uses a chute to feed a ballot into the pouch, of prior art interest is the Christensen U.S. Pat. No. 3,154,246 in which coins deposited through a slot fall into a coin bag through a chute which prevents removal of the coins from the bag. A similar coin bank is shown in the Mills et al. U.S. Pat. No. 725,858 in which coins deposited in the bank go through a chute.

SUMMARY OF INVENTION

In view of the foregoing, the main object of this invention is to provide a security ballot pouch that is tamper proof and therefore prevents unauthorized removal of any ballot deposited in the pouch.

More particularly, an object of this invention is to provide a ballot pouch of the above type that includes a fabric bag having an entry slot in the upper section of the bag from which a fabric chute depends whereby a ballot inserted in the entry slot must pass through the chute into the bag interior, the chute blocking the withdrawal of any deposited ballot back through the entry slot.

Among the significant features of the invention are the following:

A. the fabric chute which depends from the entry slot has a thickened extremity that prevent the chute from being pulled out of the entry slot to obtain access to the contents of the bag.

B. the entry slot is provided with a sealed closure so that no ballots may be deposited in the bag unless the seal is removed by one authorized to do so.

C. the bag is provided at its bottom end with a locked outlet from which the deposited ballots stored on the bag may be removed only when the outlet is unlocked by one authorized to do so.

Also an object of the invention is to provide a ballot box which may be conveniently carried to a polling place and there suspended from a wall when put to use.

Briefly stated, these objects are attained by a tamper-proof ballot pouch adapted to store ballots deposited therein and to prevent their unauthorized removal. The pouch includes a fabric bag in whose upper section is sewn a pair of parallel rods defining an entry slot to admit one ballot at a time. Depending from the upper section is fabric chute creating a narrow open channel between the entry slot and the bag interior whereby a ballot inserted in the entry slot must pass through the channel before being deposited in the bag.

Because the chute is flexible, when a ballot is inserted in the entry slot and advances into the narrow channel of the chute, it then straightens out the chute so that the channel is then in axial alignment with the entry slot. But once the ballot is deposited in the bag, its unauthorized exit through the entry slot is prevented by the chute, for regardless of how the pouch is manipulated, the deposited ballot cannot back track through the channel.

BRIEF DESCRIPTION OF DRAWING

For a better understanding of the invention as well as other objects and further features thereof, reference is made to the following detailed description to be read in conjunction with the accompanying drawings, wherein.

DESCRIPTION OF INVENTION

Figure 1:
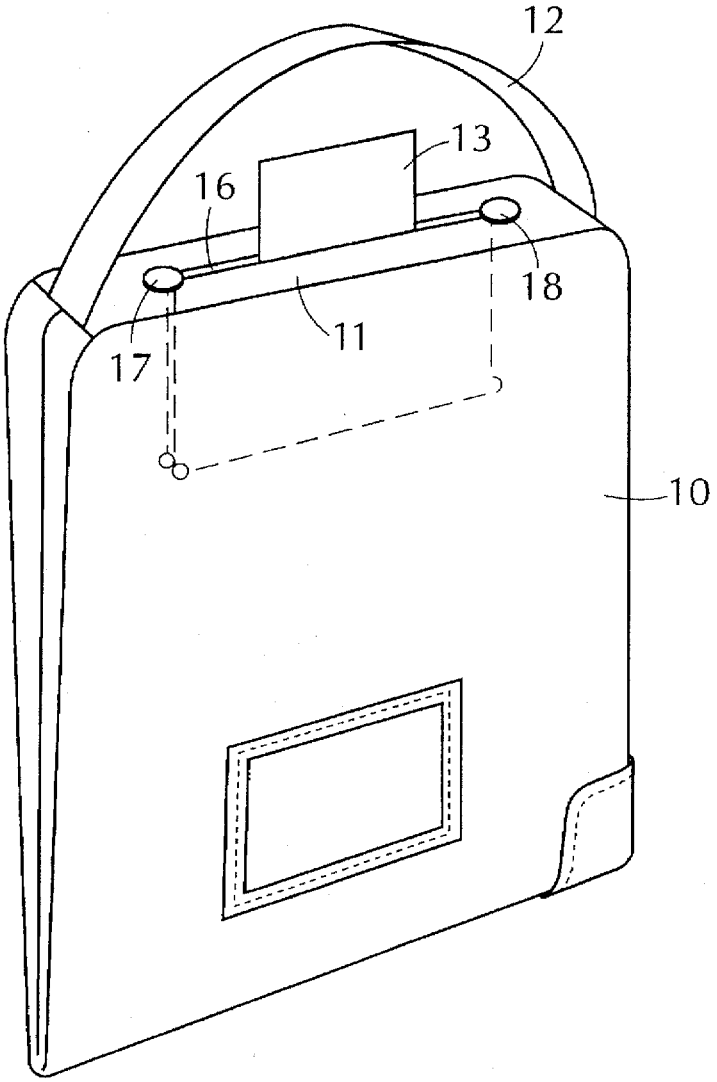
FIG. 1 is a perspective view of a ballot pouch in accordance with the invention.

Referring now to FIG. 1, there is shown a security ballot pouch in accordance with the invention, the pouch including a bag 10 of fabric or other flexible material. In practice, bag 10 may be fabricated of high strength canvas or other woven fabric whose fibers are of natural or synthetic plastic filaments.

Bag 10 is provided with a rectangular upper section 11 which is peripherally sewn to the rectangular mouth of the bag at its upper end. Attached to opposing ends of upper section 11 is a fabric strap 12 which serves as a loop handle for the pouch and also as a means to suspend the pouch from a wall or other surface when the pouch is put to use as a depository for ballots, such as the ballot 13.

Figure 2:
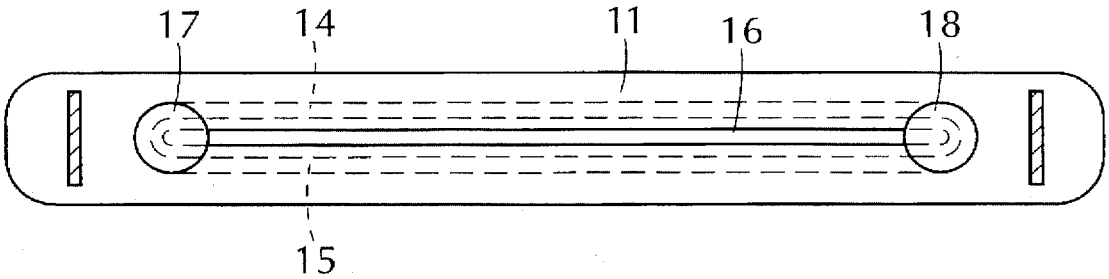
FIG. 2 illustrates the parallel rods which define the entry slot of the pouch.
Figure 4:
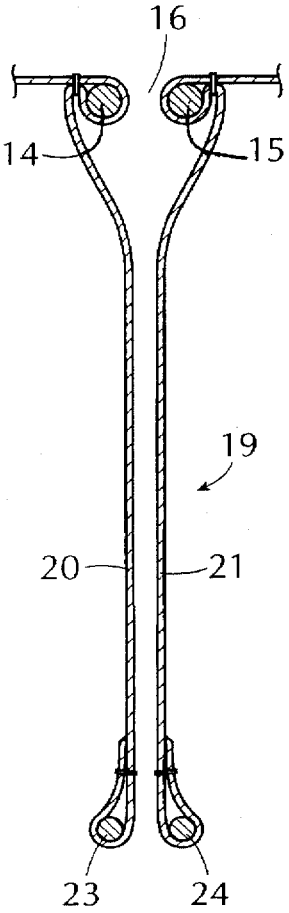
FIG. 4 shows the cords sewn into the ends of the panels at the outlet of the chute.

As shown in FIGS. 2 and 4, upper section 11 is provided with a longitudinal slit flanked by a pair of parallel metal or plastic rods 14 and 15. These are sewn into and covered by the fabric of the upper section to define a fabric-lined narrow entry slot 16.

Figure 3:
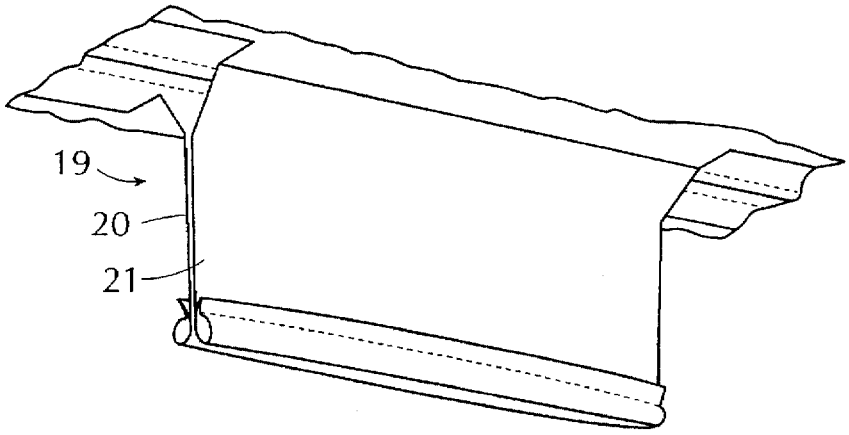
FIG. 3 is a separate view of the panels which form the fabric chute below the entry slot.
Figure 5:
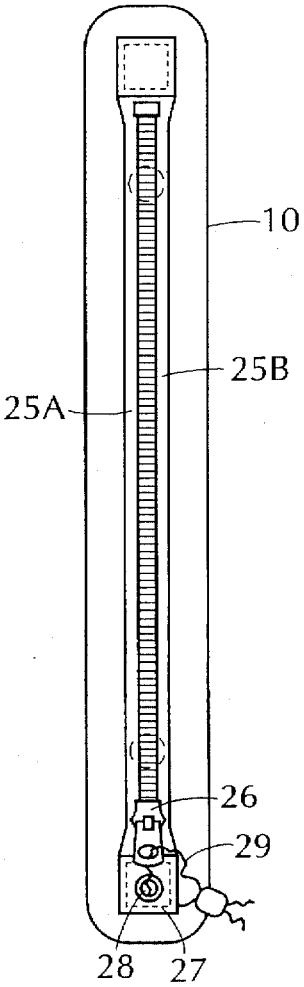
FIG. 5 shows a zipper closure placed over the entry slot at the upper section of the pouch.

The ends of parallel rods 14 and 15 are clamped together by disc-shaped rivets 17 and 18 which maintain the dimensions of entry slot 16 so that it is just wide enough to freely admit ballot 13. As shown in FIGS. 3 to 5 depending from upper section 11 of the bag in alignment with entry slot 16 is a fabric chute 19 formed by superposed fabric panels 20 and 21.

The upper ends of panels 20 and 21 are sewn to the underside of upper section 11 on either side of parallel rods 14 and 15 which define the entry slot. The opposite sides of panels 20 and 21 are sewn together to define a narrow open channel in registration with the entry slot.

The lower ends of panels 20 and 21 at the outlet of the channel are wrapped about fabric cords 23 and 24 as shown in FIG. 4 and are sewn to ensheathe these cords. These cords serve a dual purpose. First, they act to apply a weight to the outlet of the chute to maintain a straight open channel extending from the entry slot. But the more important function of the cords whose combined diameters are greater than the width of the entry slot is that should an unauthorized person seek to pull the chute out of the entry slot so as to then be able to extract deposited ballots from the bag, he cannot carry out this operation, for the thickened extremity of the chute will not go through the entry slot.

The chute therefore serves effectively as a one way valve which permits a ballot inserted in the entry slot to pass through the chute into the interior of the bag but prevents a deposited ballot to back track through the chute so that it can be taken out of the entry slot.

In FIG. 1, entry slot 16 is shown exposed so that even when the ballot pouch is being transported and is not then in use, the entry slot remains open and unprotected. It is therefore desirable, in practice, to sew onto upper section 11 of the bag on either side of entry slot 16, the complementary sections 25A and 25B of a zipper fastener having a slider 26 provided with a pull tab having a hole therein, as shown in FIG. 5.

Attached to one end of the zipper is a flexible tongue 27 having an eyelet 28 therein. To seal the closed zipper so that it cannot be pulled open, a corrugated plastic sealing wire 29 is passed through eyelet 28 and the adjacent hole in the pull tab of slider 26. One end of the wire goes through a latching socket 29 attached to the other end of the wire to form a sealing loop. In order therefore to put the pouch in service, seal 29 must be cut to release the slider of the zipper so that the zipper can be pulled open to expose the entry slot 16.

Figure 6:
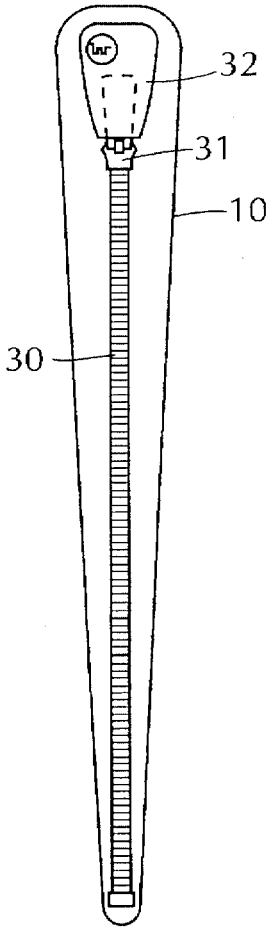
FIG. 6 shows a zipper closure at the outlet of the pouch.

The bottom end of bag 10 as shown in FIG. 6 has an open outlet from which the ballots deposited in the bag can be removed to empty the bag. Attached to this outlet is a zipper 30 whose slider 31, when the zipper is pulled closed, is then adjacent a key-operated lock 32. the slider, when inserted in lock 32 is then latched thereto.

Hence the bag outlet is normally closed and locked so that the ballots stored therein cannot be removed except by an authorized person who has the key to lock 32 and can open the outlet to remove from the bag the ballots deposited and stored therein.

A ballot pouch in accordance with the invention can also be used to receive survey forms and other filled out sheets or cards rather than ballots. The pouch affords a high measure of security, for it is effectively tamper-proof, making it virtually impossible to remove a ballot from the pouch once deposited therein, except by unlocking the outlet.

While there has been shown preferred embodiments of a security ballot pouch in accordance with the invention, it is to be understood that many changes may be made therein without departing from the spirit of the invention.

I claim:

1. A security pouch adapted to store ballots in card or sheet form and to prevent their unauthorized removal from the pouch; said pouch comprising:

A. a bag formed of flexible material having an upper section provided with a pair of parallel rods defining an entry slot to admit one ballot at a time; and B. a chute formed of flexible material depending from the upper section to create a narrow open channel between the entry slot and a narrow outlet leading to an interior of the bag whereby a ballot inserted in the slot must pass through the channel and the narrow outlet before being deposited in the bag interior, but once the ballot is deposited, its unauthorized exit through the entry slot is prevented by the narrow outlet of the chute, for regardless of how the pouch is manipulated, the deposited ballot cannot back track through the channel.

2. A pouch as set forth in claim 1, in which the bag and the chute are formed of fabric.

3. A pouch as set forth in claim 2, in which the chute is formed by a pair of superposed fabric panels whose opposite sides are sewn together to define the channel.

4. A pouch as set forth in claim 3, in which the upper ends of the panels are joined to the upper section of the bag on either side of the entry slot.

5. A pouch as set forth in claim 1, in which the lower ends of the panels each have a cord attached thereto to thicken the lower ends whereby the chute cannot be pulled out of the entry slot.

6. A pouch as set forth in claim 2, in which the upper section of the fabric bag is rectangular and has a slit therein, and the fabric adjacent either side of said slit is wrapped about said parallel rods and sewn to retain said rods.

7. A pouch as set forth in claim 1, in which the opposite ends of the parallel rods are held together by rivets.

8. A pouch as set forth in claim 1, in which the entry slot on the upper section of the bag is covered by a zipper having a slider which in its closed position is prevented from being pulled open by a seal, whereby access to the entry slot can only be obtained by breaking the seal.

9. A pouch as set forth in claim 1, in which said bag has a bottom outlet provided with a lockable zipper whereby ballots deposited in the bag can only be removed by unlocking the zipper.

* * * * *